US007319282B2

(12) United States Patent
Makino et al.

(10) Patent No.: US 7,319,282 B2
(45) Date of Patent: Jan. 15, 2008

(54) SWITCH CIRCUIT

(75) Inventors: Jun Makino, Singapore (SG); Ting Boon Ghee, Singapore (SG)

(73) Assignee: Creative Technology Ltd, Singapore (SG)

( * ) Notice: Subject to any disclaimer, the term of this patent is extended or adjusted under 35 U.S.C. 154(b) by 501 days.

(21) Appl. No.: 10/947,783

(22) Filed: Sep. 21, 2004

(65) Prior Publication Data

US 2006/0061217 A1 Mar. 23, 2006

(51) Int. Cl.
*H01H 35/00* (2006.01)

(52) U.S. Cl. ..... 307/119; 307/126; 307/141

(58) Field of Classification Search ..... 307/126, 307/119, 125, 141
See application file for complete search history.

(56) References Cited

U.S. PATENT DOCUMENTS 3,697,774 A * 10/1972 Pascente ..... 361/13
3,896,369 A * 7/1975 Nakata ..... 323/238
4,323,835 A * 4/1982 Lee ..... 318/729
4,722,021 A * 1/1988 Hornung et al. ..... 361/49
4,833,339 A * 5/1989 Luchaco et al. ..... 307/115
4,876,532 A * 10/1989 Sauls ..... 340/689
5,519,263 A * 5/1996 Santana, Jr. ..... 307/115
5,730,098 A * 3/1998 Sasaki et al. ..... 123/198 DB
5,883,401 A * 3/1999 Pezzani ..... 257/121
5,990,639 A * 11/1999 Arai et al. ..... 318/245
6,603,221 B1 * 8/2003 Liu ..... 307/125
6,630,798 B2 * 10/2003 Motomura et al. ..... 315/241 P
6,873,062 B1 3/2005 Makino
7,221,106 B1 * 5/2007 Nemir et al. ..... 315/291

FOREIGN PATENT DOCUMENTS

JP 06-291628 A 5/1998
JP 10-134688 A 5/1998
WO WO01/13492 2/2001

* cited by examiner

*Primary Examiner*—Michael Sherry
*Assistant Examiner*—Daniel Cavallari
(74) *Attorney, Agent, or Firm*—Russell N. Swerdon

(57) ABSTRACT

A switch circuit for controlling the supply of electrical power from an electrical power source to a load includes a power supply switch comprising input, output and control terminals. The circuit further includes an electronic switching device connected to the control terminal of the power supply switch and having an activating input; a momentary switch coupled to the activating input of the electronic switching device; and a charge storage element coupled to the momentary switch. In a first mode, closing the momentary switch in excess of a triggering time charges the charge storage element and triggers the electronic storage device to turn on the circuit to supply power to the load. In a second mode, closing the momentary switch connects the charge storage element to the electronic switching device to turn off the electronic switching device and the power supply switch, thus interrupting the supply of power to the load.

18 Claims, 6 Drawing Sheets

SWITCH CIRCUIT

FIELD OF THE INVENTION

The present invention relates to an arrangement for a switch circuit, in particular an improved arrangement for a switch circuit utilising a momentary switch.

BACKGROUND OF THE INVENTION

Momentary switches are commonly used for turning on and off electrical and electronic equipment. They operate in combination with a switch circuit located on a microcontroller to produce a logic type operation so that when a switch pulse is supplied to a switch circuit, the circuit switches from "off" to "on" or from "on" to "off". The switch pulse is provided by actuation of the momentary switch which when actuated completes the circuit to provide a pulse to the switch circuit to switch the state of the switch circuit.

It is common practice for a number of different types of electrical and electronic equipment to use only a single momentary switch to switch the equipment both on and off.

However, one of the disadvantages of using a single momentary switch is that, during the off state, it is still necessary for power to be supplied to the switch circuit. This is because it is necessary to maintain a live switch circuit for sensing a switch pulse generated by the momentary switch at any time. Therefore, this power consumption constantly drains the battery or AC power even though the electronic equipment appears to be in an "off" state to a user. This consumption of electrical power is especially important to battery operated equipment such as laptop computers and mobile (or hand) phones where a long battery life is preferable in order to cut down on the need to constantly change or recharge batteries.

SUMMARY OF THE INVENTION

The present invention relates to an improved arrangement for a switch circuit which is used for controlling the supply of electrical power from an electrical supply source e.g. a battery to a load. In general terms, the present arrangement for a switch circuit comprises a charge storage element which performs the dual functions of both turning on and turning off the switch circuit.

According to a first aspect of the invention, there is provided a switch circuit comprising a power supply switch comprising input, output and control terminals, wherein the input terminal of the power supply switch is coupled to the electrical power source and the output terminal of the power supply switch is coupled to the load;

an electronic switching device connected to the control terminal of the power supply switch and having an activating input;

a momentary switch coupled to the activating input of the electronic switching device;

a charge storage element coupled to the momentary switch;

the arrangement being such that (i) in a first mode, power is supplied to the load by closing the momentary switch to connect the charge storage element to the electronic switching device for a predetermined time in excess of a triggering time of the electronic switching device, the predetermined time being determined by the charge-up time of the charge storage element and triggering of the electronic switching device maintaining the power supply switch in an on state to supply power from the electrical power source to the load; and ii) in a second mode, the supply of power to the load is stopped by closing the momentary switch to connect the charge storage element to the electronic switching device, the charge storage element providing a signal to turn off the electronic switching device and the power supply switch to cut the supply of power from the electrical power source to the load. In one embodiment, the charge storage element comprises a capacitor.

Preferably, the switch circuit further comprises a charge-up time controller for the charge storage element. The triggering time of the electronic switching device can be adjusted by changing the value of the charge-up time controller. In one embodiment, the charge-up time controller comprises a resistive element.

The charge storage element and the charge-up time controller are preferably disposed in series and across the load.

According to the invention in a second aspect, the arrangement for the switch circuit is implemented as a combination of an integrated circuit with a charge storage element and a momentary switch coupled to the integrated circuit, wherein the integrated circuit comprises a power supply switch and an electronic switching device The activating input of the electronic switching device is adapted for connecting the integrated circuit to a momentary switch. Additionally, the integrated circuit is also provided with means for receiving a supply of electrical power from an electrical power source and a first and second connection means for connecting the integrated circuit to a respective load and a charge storage element.

According to the invention in a third aspect, a momentary switch is coupled to an assembled integrated circuit and packaged integrally with the integrated circuit to form a switching structure. The integrated circuit comprises some or all of the components of a switch circuit (excluding the momentary switch).

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT OF THE INVENTION

Figure 1:
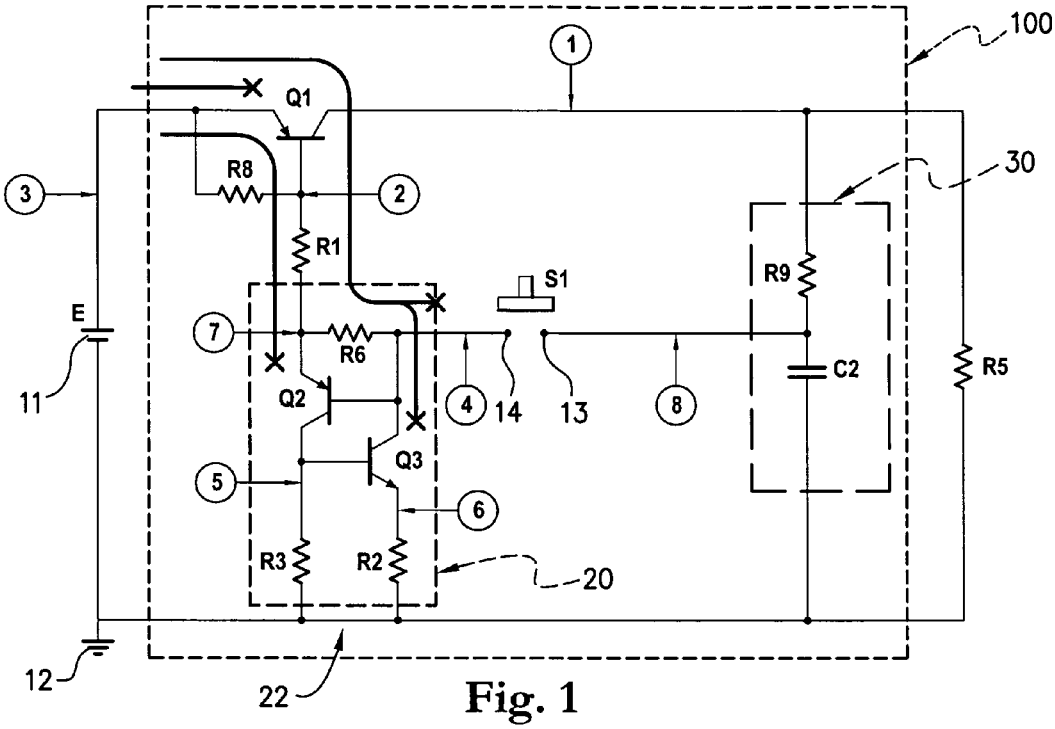
FIG. 1 is a circuit diagram of a first example of a switch circuit, in which the switch circuit is in an "off" state.

FIG. 1 illustrates a switch circuit 100 in accordance with one embodiment of the present invention. The switch circuit 100 acts as an interface between a power supply in the form of a battery 11 and a load represented by resistor R5. The switch circuit 100 comprises a first transistor Q1 which acts as a power supply switch, a resistor R1, an electronic switching device 20, a momentary switch S1 and a charge storage and discharge circuit 30.

As shown in FIG. 1, the transistor Q1 is of pnp bipolar type, the emitter terminal of which being coupled to the positive terminal of the battery 11 while the collector terminal is connected to one side of the load R5. A resistor R8 is coupled between the emitter terminal and the base terminal of the transistor Q1.

The electronic switching device 20 comprises an input terminal 7 which is connected to the base of the transistor Q1 via resistor R1, an output 22 coupled to the negative terminal of the battery and an activating input 4 coupled to a first contact 14 of the momentary switch S1. In this embodiment, the electronic switching device comprises second and third bipolar transistors Q2 and Q3 connected as a thyristor device.

Second transistor Q2 is a pnp bipolar transistor. The emitter of the second transistor Q2 is coupled to the base of transistor Q1 via a resistor R1 and to the contact 14 of the momentary switch S1 via a resistor R6. The contact 14 of the momentary switch S1 is also coupled to the base terminal of the second transistor Q2 and to the collector terminal of the third transistor Q3. Third transistor Q3 is an npn bipolar transistor. The base of the third transistor Q3 is coupled to the collector of the second transistor Q2 and the emitter of the third transistor Q3 is coupled to a ground potential 12 via a resistor R2. The collector of the second transistor Q2 is also coupled the ground potential 12 via resistor R3.

Another contact 13 of the momentary switch S1 is coupled to the collector terminal of transistor Q1 via resistor R9 and also to the ground potential via capacitor C2. In this embodiment, resistor R9 and capacitor C2 make up the charge storage and discharge circuit 30.

The positive terminal of the battery 11 is coupled to the emitter terminal of the first transistor Q1 and the resistor R8 while the negative terminal of the battery 11 is coupled to the ground potential 12. However, alternatively, the negative terminal of the battery 11 may be coupled to a floating potential.

In use, the switch circuit 100 operates as follows:

Initially, with the momentary switch S1 in the position shown in FIG. 1, the switch circuit 100 is in the off state and the transistors Q1, Q2 and Q3 are turned off. Hence, there is no closed circuit path and the switch circuit 100 acts to prevent power being supplied from the battery 11 to the load R5.

When the switch circuit 100 is in the off state, the only power consumption is a reverse leakage power consumption through the transistors Q1, Q2, Q3 which is virtually negligible compared to the self discharging current of the battery 11.

Accordingly, the initial potential at the points 1, 2, 3, 4, 5, 6, 7, 8 in the circuit 100 and the status of the transistors are as follows:

The potential at point 3=E (the potential of the battery 11);

The potential at point 1=0, as the transistor Q1 is switched off;

The potential across the base-emitter junction of the first transistor Q1=0;

The potential at point 2=the potential at point 3=E;

The current through R1=0;

The potential at point 7=the potential at point 2=E;

The voltage across the base-emitter junction of the second transistor Q2=0, as the second transistor Q2 is switched off;

The potential at point 4=the potential at point 7=E; Current through R3=0;

The potential at point 5=0;

The voltage across the base emitter junction of the third transistor Q3=0;

The current through the resistor R2=0;

The potential at point 6=0;

The potential across the capacitor C2=0; and

The potential at point 8=the potential at point 1=0.

Figure 2:
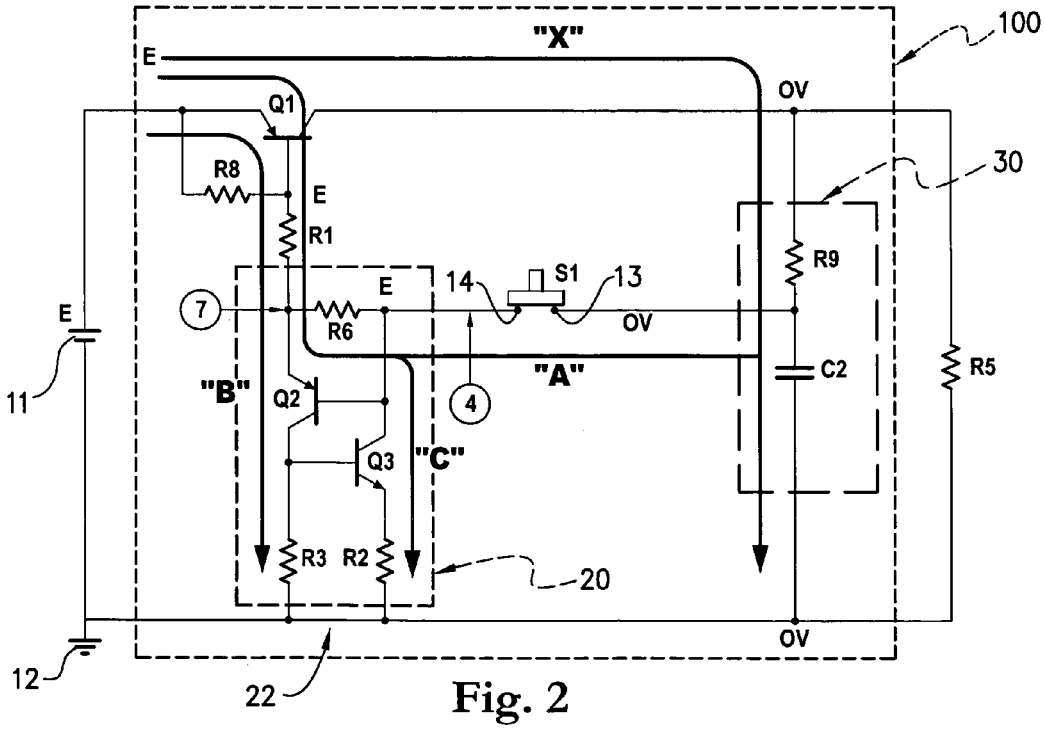
FIG. 2 is a circuit diagram of the switch circuit of FIG. 1 with the momentary switch in a closed position during switching on of the switch circuit.

When the momentary switch S1 is pressed to complete the contacts 13, 14 as shown in FIG. 2, point 4 is driven to zero potential and an initial closed circuit (path A) is formed. This causes the base-emitter junctions of the first and second transistors Q1, Q2 to be forward biased thereby turning on transistors Q1, Q2. The initial current generated contributes to the base current for the first and second transistors Q1, Q2 and surges across the resistor R1 through path A. This surge in base current drives the first and second transistors Q1, Q2 into saturation mode. Immediately after path A is formed, the initial surge current passes through to resistor R3 (path B). As the voltage across R3 is raised rapidly due to the surge current, the base-emitter junction of the third transistor Q3 is forward biased thereby turning on the third transistor Q3. Similarly, the third transistor Q3 is also driven into saturation mode.

The current through path A is in the form of a pulse which rapidly becomes zero due to the presence of the capacitor C2 which is charged up to a constant value Vs thereby rendering path A open circuit. In FIG. 2, the voltage Vs given by $$(E - 2V_{be}) \times \frac{R_2 // R_3}{R_1 + R_2 // R_3},$$

whereby $R_2//R_3$ refers to the effective resistance of resistors R2 and R3 which are connected in parallel. When capacitor C2 is charged to a voltage of Vs, this prevents further current from passing through the capacitor C2 and path A becomes open circuit. Therefore, even if momentary switch S1 continues to remain pressed, path A will eventually become open circuit when C2 charges to Vs. As we shall see in the following paragraph, the switch circuit 100 is configured such that the battery 11 continues to deliver electrical power to the load even after capacitor C2 charges to Vs and path A becomes open circuit. Upon deactivation of S1, C2 continues to be charged up through path X to a voltage of about E-0.2V. This is because the voltage drop across the collector-emitter junction of transistor Q1 is typically about 0.2 V when transistor Q1 is in saturation mode.

The second and third transistors Q2, Q3 form a thyristor device which is triggered by the surge current generated in the switch circuit 100 when the momentary switch S1 is actuated. The third transistor Q3 takes its base current from the second transistor Q2 and at the same time, the third transistor supplies the base current to the second transistor Q2. The advantage of using a thyristor device is that once the thyristor device enters a latched on state, it continues to conduct even without current supply at the activating input 4 (either due to the momentary switch being released or capacitor C2 being charged to a constant value Vs). This is because when the thyristor is in the latched on state, the voltage across the base-emitter junction of the second transistor Q2 is maintained forward biased with the third transistor Q3 in saturated mode as illustrated by path C while the voltage across the base-emitter junction of the third transistor Q3 is kept forward biased by the second transistor Q2 operating in saturated mode as shown by path B. In this way, even without current supply at the activating input 4, the combination of the second and third transistors, Q2, Q3 will keep each other conducting as long as the battery 11 is coupled to the emitter of the second transistor Q2, that is the battery 11 is coupled to point 7 in the switch circuit 100. Therefore, once the thyristor device enters a latched on state, the closed circuit path B and path C maintain the forward biasing of the base-emitter junctions of the second and third transistors Q2, Q3 even when path A becomes open circuit. Accordingly, with the thyristor device switched on, the base-emitter junction of the first transistor Q1 is also maintained in a forward biased mode with its base current driven into saturation mode. Therefore, in this state the switch circuit 100 is turned on and power is supplied through the transistor Q1 to the load R5.

However, a sufficient amount of triggering energy must be provided in order for the thyristor device to enter a latched on state and continue to conduct even after path A becomes open circuit. This triggering energy is expressed in terms of the minimum triggering current through transistor Q3 that has to be exceeded in order for the transistor Q3 to remain switched on permanently. The current through transistor Q3 is dependent on its base emitter voltage, that is the voltage across points 5 and 6. Since the voltage at point 5 is dependent on the voltage at point 4, the voltage at point 5 and hence current through transistor Q3 rises as capacitor C2 is being charged up. When capacitor C2 is charged above a certain voltage, the current through transistor Q3 rises above the triggering current required and the transistor Q3 is switched on permanently. Accordingly, this means that switch S1 has to be pressed for a triggering time that is required for the triggering current to be exceeded. In this embodiment, the triggering time is dependent on how fast C2 charges up.

As seen from the above, the supply of electrical power from the battery 11 to a load R5 is activated by pressing switch S1 for a duration that exceeds the triggering time. When switch S1 is actuated to complete the contacts 13, 14, the capacitor C2 is charged up through both paths A and X while paths B and C draw current away from paths A and X. Since C2 is charged through resistor R9 along path X, R9 provides a charge-up time controlling function. The triggering time can thus be adjusted by adjusting the value of C2 and R9. and ideally this should not be too short, in order to prevent misfiring of the thyristor device.

This advantageously allows the triggering time to be pre-fixed as it is independent of the value of any filtering capacitance which is commonly connected in parallel with the load. In our previous PCT application PCT/SG99/00084, a switch circuit was disclosed whereby the triggering time was determined by a capacitor connected in parallel with the load. In this case, the resulting triggering time was difficult to predict as it was not independent of the filtering capacitance.

Figure 3:
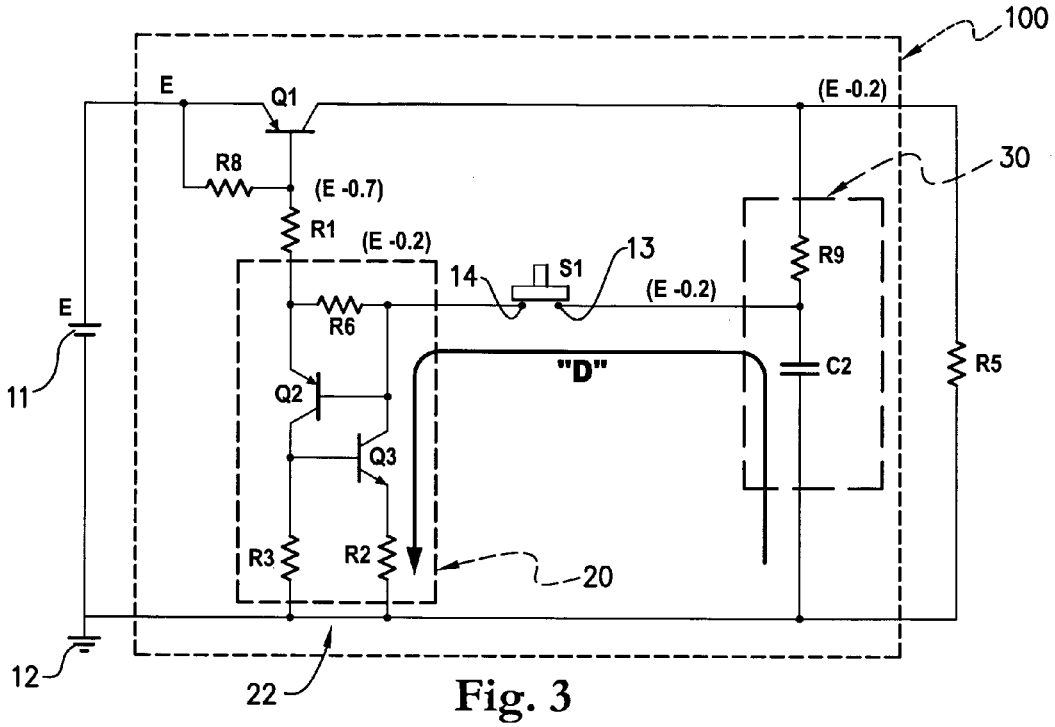
FIG. 3 is a circuit diagram of the switch circuit of FIG. 1 with the momentary switch in a closed position during switching off of the switch circuit.

When the momentary switch S1 is actuated again to complete the contacts 13, 14 (see FIG. 3) a closed circuit path D is formed in the switch circuit 100 as the capacitor C2 discharges. Therefore, C2 functions as a charge storage device which is charged up when the switch circuit switches from "off" to "on" and discharges when the circuit switches from "on" to "off". Point 4 is momentary short circuited to point 8 during actuation of the switch S1 and it becomes the same potential as point 8 which is E—0.2 volts. However, the voltage at point 2 during the on state of the circuit 100 is about E-0.7 volts. This is because the voltage drop across the base-emitter junction of transistor Q1 is typically about 0.7V. Therefore, when point 4 goes to E-0.2 volts, the base-emitter junctions of the first transistor Q1 and the second transistor Q2 are no longer forward biased and the first and second transistors Q1, Q2 are switched off. With the second transistor Q2 in its off mode, the collector of the second transistor Q2 is also switched off which switches off the third transistor Q3. Therefore, the discharge of capacitor C2 provides a signal to switch off switch circuit 100 and as the first transistor Q1 is switched off, no power is supplied from the battery 11 to the load R5. When the momentary switch S1 is released, the remaining charge in the capacitor C2 discharges through the load R5 and resistor R9.

As seen from the above, actuating momentary switch S1 momentarily while the switch circuit 100 is in the "on" state switches off the first transistor Q1 and the thyristor device as a reverse bias voltage is established across the first and second transistors Q1, Q2. If momentary switch S1 is not released but continues to remain pressed, the voltage at point 4 will decrease as capacitor C2 starts to discharge. When the voltage at point 4 reaches a sufficiently low level, transistor Q1 will start to conduct again as its base-emitter junction becomes forward biased. Accordingly, power will be supplied to the load R5, although at a lower level since the thyristor is not activated unlike during the "on" state of the switch circuit 100 mentioned in the previous paragraphs. When the momentary switch S1 is finally released, power supply to the load R5 will be cut off as Q1 switches off and any remaining charge in the capacitor C2 discharges through the load R5 and R9. After the capacitor C2 discharges completely, the switch circuit 100 reverts back to the initial off state in which no power is supplied to the load R5 from the battery 11 and the only power consumed by the circuit 100 is the reverse leakage current through the first, second and third transistors Q1, Q3, Q2 which is virtually negligible.

The values of resistor R9 and capacitor C2 are chosen to take into account the need for capacitor C2 to discharge as the switch circuit reverts back to the initial "off" stage where it is able to sense a switch pulse generated by the momentary switch at any time. Therefore the values of R9 and C2 cannot be too large or it will affect the ability of the switch circuit to react to switch pulses. On the other hand, C2 also has to sustain a voltage that is high enough to switch off Q1 and the electronic switching device when a request is made to switch from an "on" to "off" state. In a preferred embodiment of the invention, when the voltage supply is between 1.8 to 10V, the value of resistor R9 is between 22 to 82 k ohms and capacitance of C2 between 200 nF to 10 μF.

Figure 4:
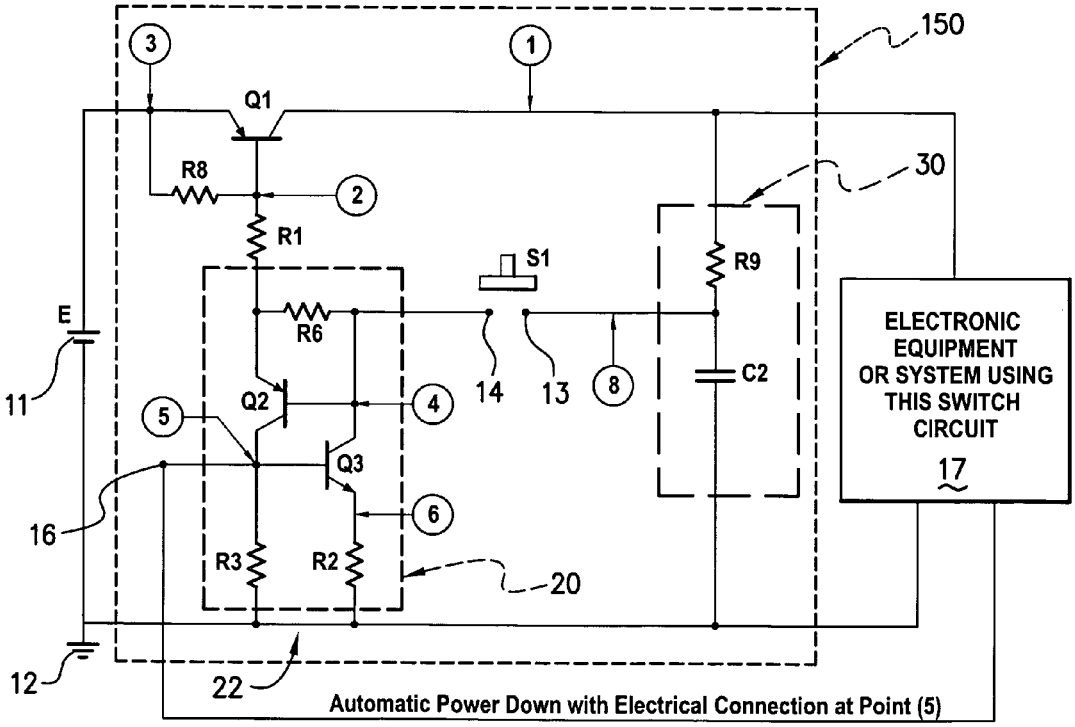
FIG. 4 is a circuit diagram of a second example of a switch circuit.

A second example of a switch circuit 150 is shown in FIG. 4. The switch circuit 150 is identical to the switch circuit 100, except that the circuit includes a signal input contact 16 at point 5 of the circuit. The signal input contact 16 is connected to electronic equipment 17, which is the equivalent of the load R5 shown in FIGS. 1 to 3. The signal input contact 16 permits the electronic equipment 17 to turn itself off automatically, for example, after a predetermined period of time. The electronic equipment 17 turns the switch circuit 150 to the off state by applying a ground potential to the signal input contact 16 which switches off the third transistor Q3 which in turn switches off the second transistor Q2. This causes the electronic switching device 20 to become open circuit which switches off the first transistor Q1 to cut off power supply from the battery 11 to the electronic equipment 17. In another embodiment of FIG. 4, the electronic equipment 17 may also be used to turn on the switch circuit 150 by supplying a sufficiently high voltage level to the signal input contact 16.

Figure 5:
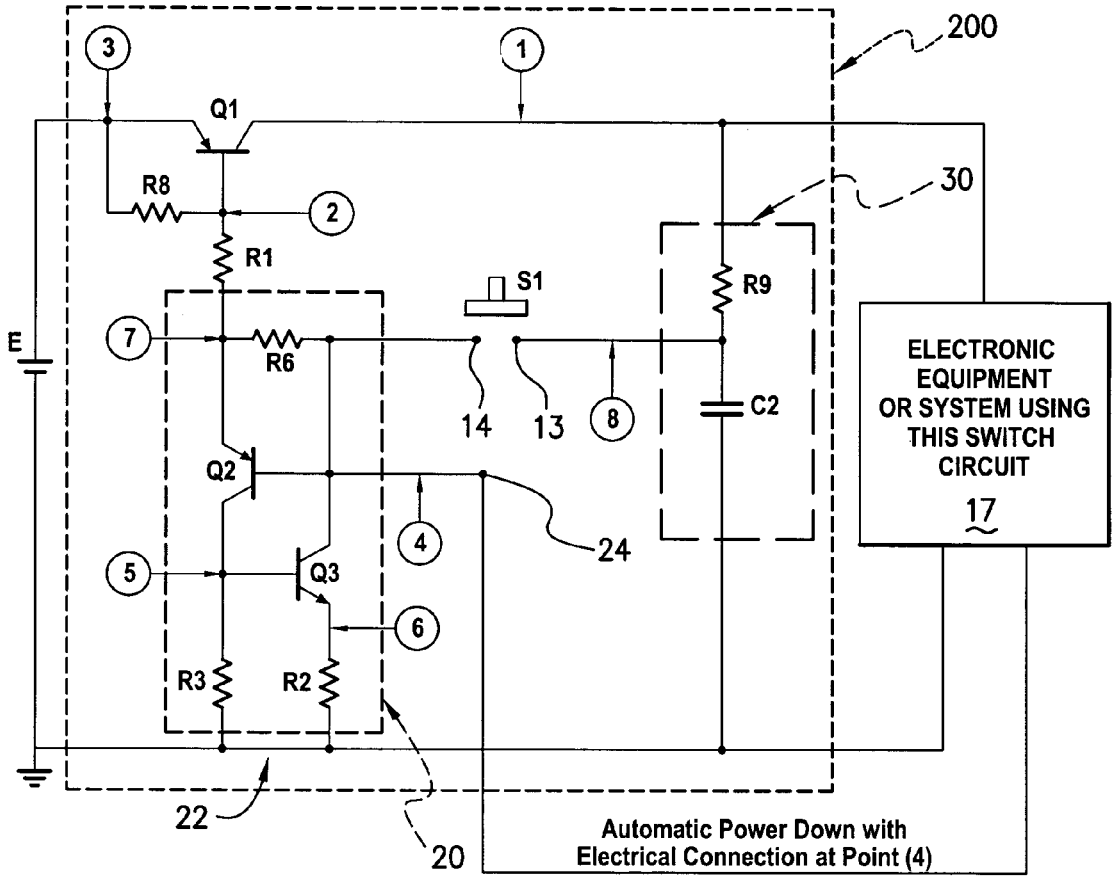
FIG. 5 is a circuit diagram of a third example of a switch circuit.

FIG. 5 shows a third example of a switch circuit 200 which is similar to the switch circuit 150 except a signal input contact 24 is connected at point 4. The signal input contact 24 when coupled to the electronic equipment 17 permits the electronic equipment 17 to switch off the switch circuit 200 by applying a high voltage state signal to contact 24. This causes the base emitter junction of the first and second transistors Q1, Q2 to be reversed biased which switches the first and second transistors Q1, Q2 off. With the first and second transistors Q1, Q2 switched off, the third transistor Q3 is also switched off as the potential at point 5 drops to zero and the switch circuit 200 is switched into the off state. In another embodiment of FIG. 5, the electronic equipment 17 may also be used to turn on the switch circuit 200 by supplying a ground potential to the signal input contact 24.

Figure 6:
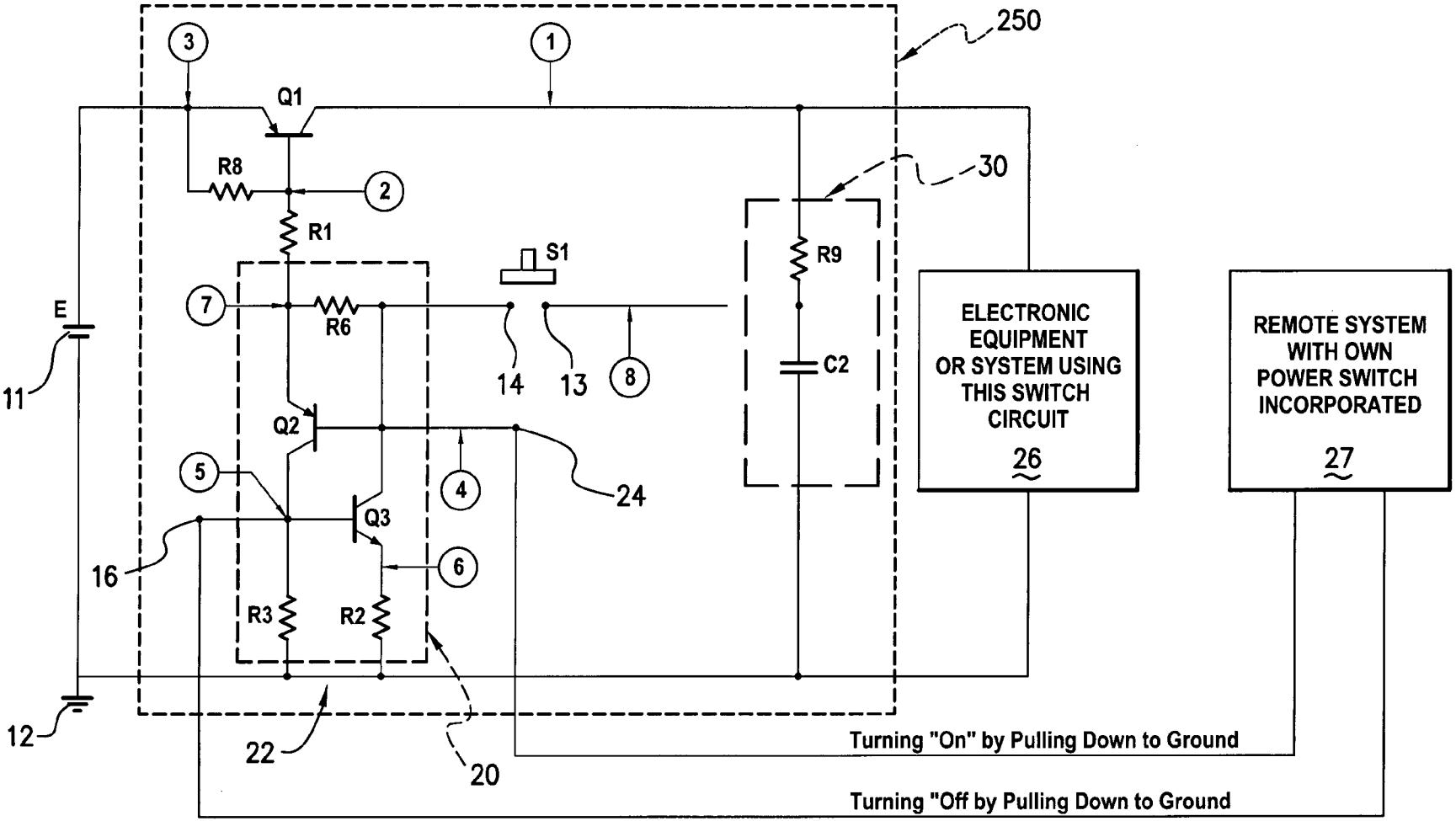
FIG. 6 is a circuit diagram of a fourth example of a switch circuit.

FIG. 6 shows a fourth example of a switch circuit 250. The switch circuit 250 is provided with a first switch signal input contact 16 connected to point 5 and a second switch signal input contact 24 connected to point 4. The switch circuit 250 controls the supply of power from the battery 11 to electronic equipment 26. The switch input contacts 16, 24 are coupled to a remote electronic system 27 which has its own power switch incorporated therein. The power switch incorporated within the remote electronic system 27 may be a switch circuit similar to any of the switch circuits 100, 150, 200, or may also be a switch circuit 250, controlled remotely by a further remote electronic system.

The switch circuit 250 permits remote power control from the other remote electronic system 27 and may be used for example, with a multi-unit system. The remote system 27 can switch the switch circuit 250 to the on state by applying a ground potential (or a sufficiently low level voltage) to the signal input contact 24 to forward bias transistor Q2. Alternatively, the remote system 27 can switch the switch circuit 250 to the off state by applying a ground potential signal to signal input contact 16.

In all the switch circuits 150, 200, 250 a momentary switch S1 is still provided which permits a user to manually switch circuits 150, 200, 250 between the off and on states. In the instances where a user wishes to use the momentary switch instead of the electronic equipment 17 or remote system 27 to toggle the switch circuit 150, 200, 250 between on and off states, the electrical connection between the electronic equipment 17 and the signal input contact 16, 24 is maintained at a high impedance. Alternatively, it is also possible to disable the momentary switch S1 and rely on the remote system 27 to control the toggling of the switch circuit. In this case, if the control signal is applied at the signal input contact 16, maintaining a sufficiently high potential at signal input contact 16 keeps the switch circuit in an "on" state as the base-emitter junction of transistor Q3 is forward biased while maintaining a ground potential reverse bias the base-emitter junction of transistor Q3 and the switch circuit remains turned off. As for signal input contact 24, maintaining a ground potential at signal input contact 24 keeps the switch circuit in an "on" state as the base-emitter junction of transistor Q2 is forward biased while maintaining a high potential reverse bias the base-emitter junction of transistor Q2 and the switch circuit remains turned off.

As an alternative to the remote system being connected to separate input contacts 16, 24 it is possible that the remote system 27 could be connected by a single line to either the switch circuit 150 or the switch circuit 200. In the case of the switch circuit 150, the remote system 27 would switch on the circuit 150 by supplying a sufficiently high voltage level to the signal input contact 16 and switch off the circuit 150 by applying a ground potential to the signal input contact 16.

Where the remote system 27 is connected to signal input contact 24 in circuit 200, the remote system 27 would switch on the circuit 200 by applying a ground potential to the signal input contact 24 and switch off the circuit 200 by applying a sufficiently high voltage level to the signal input contact 24 to reverse bias the first and second transistors Q1, Q2.

Although the switches 100, 150, 200, 250 are shown controlling the supply of power from a battery 11 to load R5 or electronic equipment 17, 26, the circuits could also be used to control the supply of power from a rectified AC supply and from an AC main supply to electronic equipment having a heavy power consumption.

Figure 7:
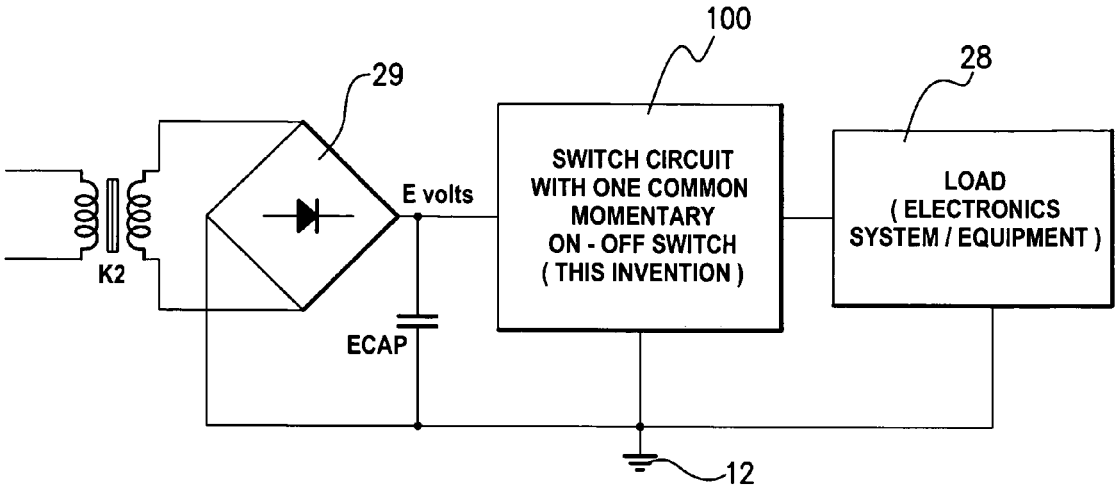
FIG. 7 is a schematic diagram showing the switch circuit of FIGS. 1 to 3 being used to control electrical power from a rectified AC mains supply.

FIG. 7 shows an example of the switch circuit 100 being used to control a rectified AC power supply from a transformer K2 and a full wave rectifier 29 to a load 28. However, switch circuit 100 could be replaced by any of switch circuits 150, 200, 250.

Figure 8:
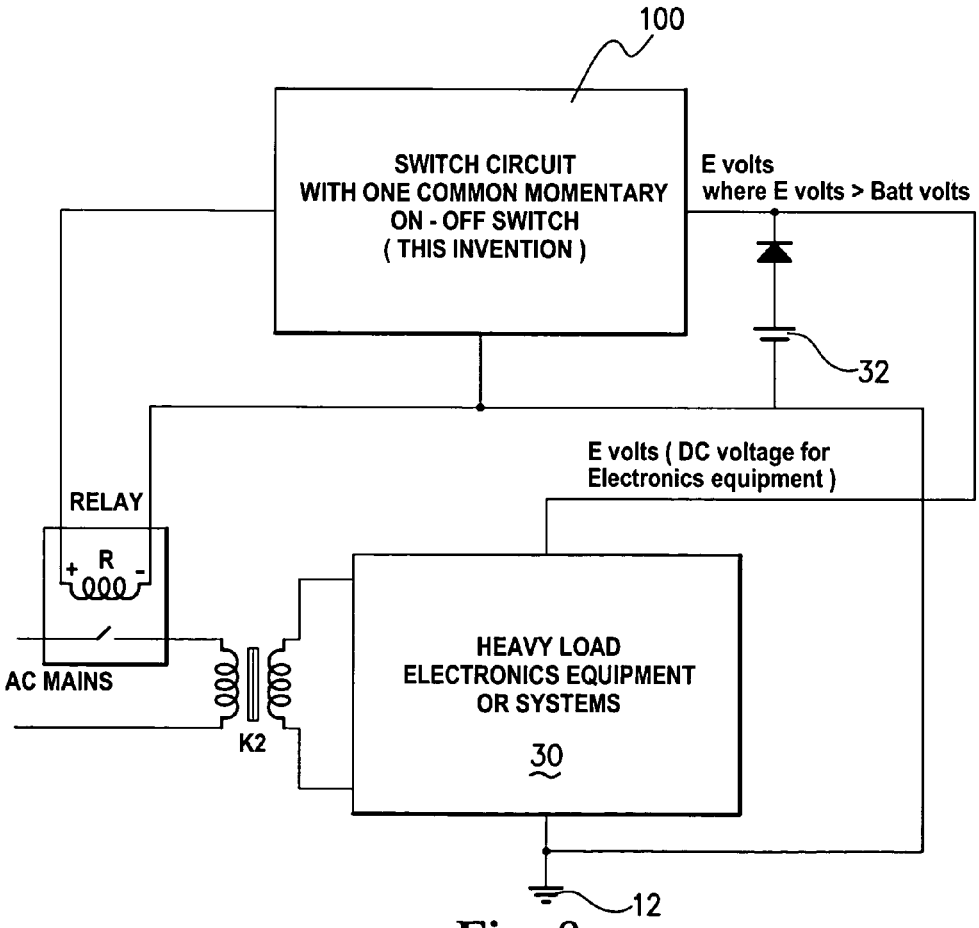
FIG. 8 is a schematic diagram showing the switch circuit of FIGS. 1 to 3 being used to control an AC power supply for a high power consumption load; and, FIG. 9 is a circuit diagram of a fifth example of a switch circuit.

FIG. 8 shows the switch circuit 100 being used to control power supply from an AC mains supply to a heavy load 30 through a transformer K2, a relay R, a diode D4 and a battery 32.

Figure 9:
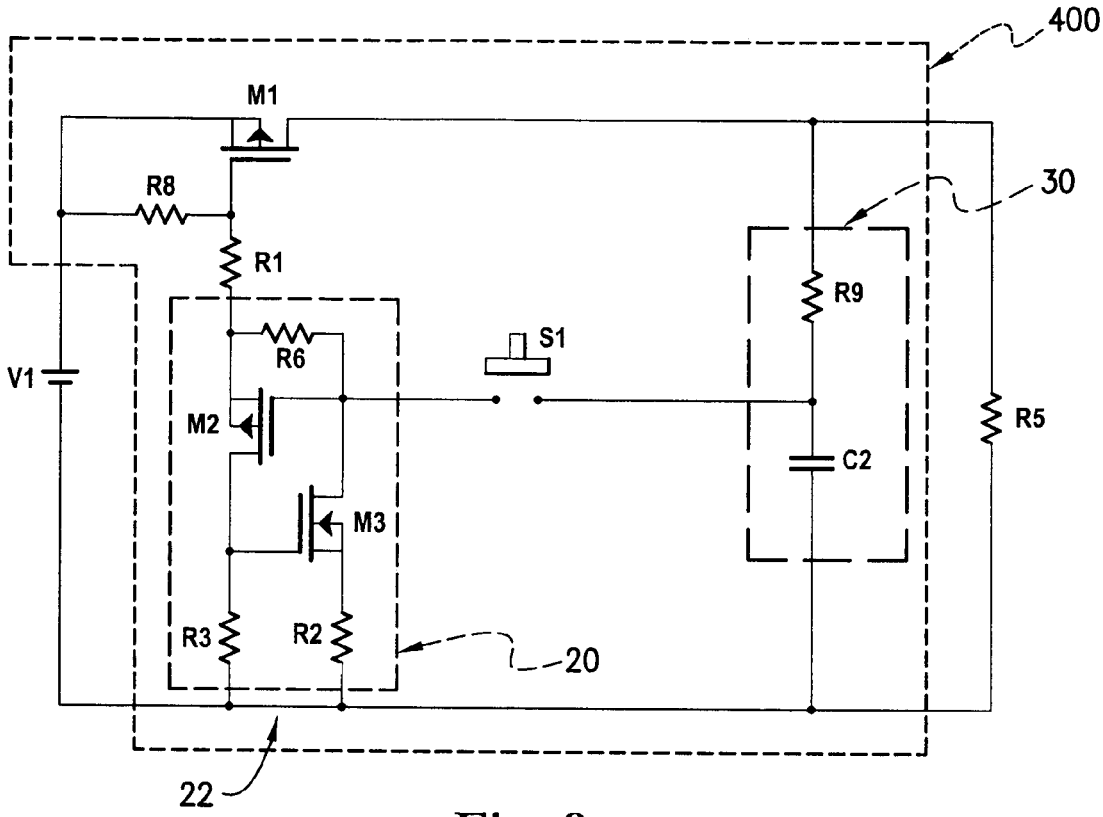

FIG. 9 is a circuit diagram showing a fifth example of a switch circuit 400. The switch circuit 400 is identical to the switch circuit 100 except that the bipolar transistors Q1, Q2, Q3 are replaced by enhancement type MOSFETs M1, M2, M3 respectively. The transistors M1, M2 are P channel enhancement type MOSFETs and the transistor M3 is a N channel enhancement type MOSFET. The principle of operation of the switch circuit 400 is identical to the switch circuit 100.

The embodiments described lend themselves to integrated circuit implementation, with most of the components assembled together on an integrated circuit. The remaining components of the switch circuit are connected to the integrated circuit via connection means provided on the integrated circuit. Furthermore, the integrated circuit may also be provided with means for connecting to an electrical power source and/or a load. In one embodiment, the integrated circuit is encapsulated in an electrically insulating material and with the connection means on the integrated circuit electrically coupled e.g. by wire bonds or flip chip connections to one end of the connection leads located on the surface or extending outwards of the encapsulating material. The connection leads provide electrical connection to the devices located outside of the integrated circuit. In a preferred embodiment, the switch circuit is implemented with the first transistor Q1, resistor R9 and electronic switching device 20 assembled on an integrated circuit. The capacitor C2, momentary switch S1, electrical power source 11 and load R5 are then connected to the integrated circuit via connection means provided on the integrated circuit. The momentary switch S1 and capacitor C2 are connected in series so that when the momentary switch is actuated, capacitor C2 is coupled to the activating input 4 of the electronic switching device. In this case, since resistor R9 is located within the IC, the triggering time of the resulting switch circuit is adjusted by varying the value of the externally located capacitor C2.

In addition to the above, the integrated circuit assembled may also be provided with connection means which allow the switch circuit to be switched on or off remotely via the electronic equipment being switched 17 or a remote system 27. In one embodiment, the connection means is coupled to the electronic switching device at the signal input contacts 16 or 24 so that the electronic switching device and hence the switch circuit may be selectively switched on or off remotely. Therefore, a user of the integrated circuit has the option of either using a momentary switch or remote system in combination with the integrated circuit.

Figure 10:
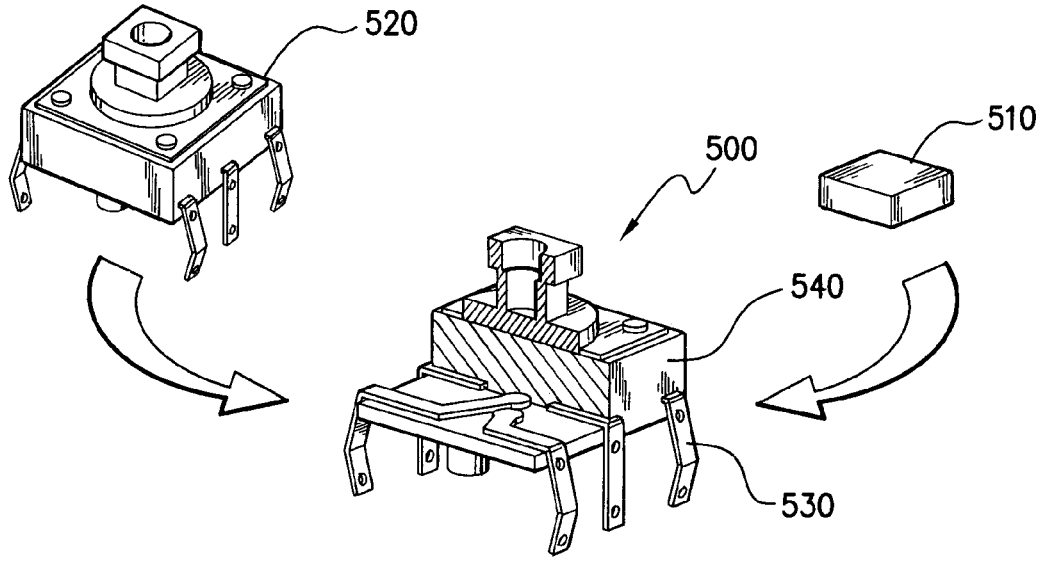
FIG. 10 is a perspective view of a switching structure in accordance with the third aspect of the invention.

Since the momentary switch returns to its normally open position when released, it is conventionally implemented with a relay or microcontroller which ensures continued power delivery to the load even after the switch is released. In accordance with a third aspect of the present invention, a momentary switch 520 is packaged together with an integrated circuit 510 to produce a switching structure 500 shown in FIG. 10. The integrated circuit comprises some or all of the components of a switch circuit (excluding the momentary switch) used for controlling the supply of electrical power from an electrical power supply to a load. The momentary switch 520 is electrically coupled to the integrated circuit via connection means provided on the integrated circuit 510 thereby providing a stand alone momentary switch which is able to latch onto an "on" state without the assistance of a relay or microcontroller. Examples of switch circuits which are applicable include both the embodiments encompassed by the present invention as well as those of our previous PCT application PCT/SG99/00084. The elimination of a microcontroller also advantageously reduces the "off" state power consumption since the embodiments of the switch circuit in both the present invention and that of PCT application PCT/SG99/00084 do not require a live switch circuit for sensing a switch pulse generated by actuating the momentary switch.

The switch circuit described in FIGS. 1 to 9 comprises a charge storage element which performs the dual functions of turning on and off the switch circuit while in the switch circuit of PCT/SG99/00084 separate modules are required. Specifically, for the switch circuit of PCT/SG99/00084 a pulse generation device which comprises a capacitor and resistor connected in parallel is used for turning on the switch circuit while a charge storage device comprising a capacitor is used for turning off the switch circuit. Preferably the power supply switch Q1 and electronic switching device 20 which are common to both switch circuits are assembled on the integrated circuit 510 of the switching structure 500. The combination of the power supply switch Q1 and electronic switching device 20 form an electronic latching switch which switches between a conductive and non-conductive mode in response to an actuation of the momentary switch. Meanwhile, the charge storage element, charge storage device and at least a portion of the pulse generation device are preferably located outside of the switching structure 500 with connection means being provided to connect them to the integrated circuit. In one embodiment where the switching structure 500 is based on the switch circuit of PCT/SG99/00084, the pulse generation device is arranged with the resistor located on the integrated circuit 510 and the capacitor located outside the switching structure. In this way, the switching structure 500 in combination with the externally coupled components form a switch circuit.

In a preferred embodiment, the integrated circuit 510 packaged with the momentary switch 520 includes the first transistor Q1, resistor R9 and electronic switching device 20 as well as means for connecting the momentary switch 520, a capacitor C2, an electrical power source 11 and a load R5 to the integrated circuit. The integrated circuit 510 is mounted on a lead frame 530 with the leads of the lead frame 530 providing electrical connection between the integrated circuit 510 and the external devices. An electrically insulating housing 540 encapsulates the integrated circuit 510 with the momentary switch 520 protruding out of the housing 540 so that it can be actuated externally by a user. Although the switch structure 500 shown in FIG. 10 uses a lead frame 530, other types of packaging substrate such as surface mount substrates are also suitable.

An integrated circuit and switch structure as described above used in a wide range applications such as in battery operated devices or even in conjunction with a microprocessor to reduce the off-state power consumption of the microprocessor.

While the invention has been particularly shown and described with reference to various embodiments, it will be recognised by those skilled in the art that modifications and changes may be made to the present invention without departing from the scope thereof. The scope of the invention should therefore be determined not with reference to the above description but with reference to the appended claims.

The invention claim is:

1. A switch circuit for controlling the supply of electrical power from an electrical power source to a load, the switch circuit comprising a power supply switch having input, output and control terminals, wherein the input terminal of the power supply switch is coupled to the electrical power source and the output terminal of the power supply switch is coupled to the load;

an electronic switching device connected to the control terminal of the power supply switch and having an activating input;

a momentary switch coupled to the activating input of the electronic switching device;

a charge storage element coupled to the momentary switch;

the arrangement being such that (i) in a first mode, power is supplied to the load by closing the momentary switch to connect the charge storage element to the electronic switching device for a predetermined time in excess of a triggering time of the electronic switching device, the predetermined time being determined by the charge-up time of the charge storage element and triggering of the electronic switching device maintaining the power supply switch in an on state to supply power from the electrical power source to the load; and ii) in a second mode, the supply of power to the load is stopped by closing the momentary switch to connect the charge storage element to the electronic switching device, the charge storage element providing a signal to turn off the electronic switching device and the power supply switch to cut the supply of power from the electrical power source to the load.

2. A switch circuit according to claim 1, wherein the electronic switching device comprises a thyristor device.

3. A switch circuit according to claim 1 wherein the power supply switch comprises a transistor.

4. A switch circuit as claimed in claim 1 wherein the electronic switching device and/or power supply switch are formed from at least one bipolar transistor.

5. A switch circuit as claimed in claim 1 wherein the electronic switching device and/or power supply switch are formed from at least one MOSFET.

6. A switch circuit according to claim 1, wherein the power supply switch and the electronic switching device are assembled together on an integrated circuit.

7. A switch circuit according to claim 1, wherein the charge storage element comprises a capacitor.

8. A switch circuit as claimed in claim 1 further comprising a charge-up time controller for the charge storage element.

9. A switch circuit as claimed in claim 8 wherein the charge-up time controller comprises a resistive element.

10. A switch circuit as claimed in claim 9 wherein the charge storage element and charge-up time controller are disposed in series and across the load.

11. A switch circuit as claimed in claim 10 wherein the momentary switch is connected between the charge storage element and the charge-up time controller.

12. A switch circuit according to claim 8, wherein the power supply switch, electronic switching device and charge-up time controller are assembled together on an integrated circuit.

13. An integrated circuit for controlling the supply of electrical power from an electrical power source to a load, the integrated circuit comprising means for receiving a supply of electrical power from an electrical power source;

a first connection means arranged to connect the integrated circuit to a load;

a second connection means arranged to connect the integrated circuit to a charge storage element, wherein the second connection means is coupled to the first connection means;

a power supply switch having input, output and control terminals, wherein the input terminal of the power supply switch is coupled to the means for receiving a supply of electrical power and the output terminal of the power supply switch is coupled to the first connection means;

an electronic switching device connected to the control terminal of the power supply switch and having an activating input arranged to connect the integrated circuit to a momentary switch;

the arrangement being such that (i) in a first mode, power is able to be supplied to a said load by closing a said momentary switch to connect to the electronic switching device for a predetermined time in excess of a triggering time of the electronic switching device a said charge storage element disposed in series with the said momentary switch, the predetermined time being determined by the charge-up time of the said charge storage element and triggering of the electronic switching device maintaining the power supply switch in an on state to supply power from the said electrical power source to the said load; and ii) in a second mode, the supply of power to the said load is stopped by closing the said momentary switch to connect the said charge storage element to the electronic switching device, the said charge storage element providing a signal to turn off the electronic switching device and the power supply switch to cut the supply of power from the said electrical power source to the said load.

14. An integrated circuit according to claim 13 further comprising a charge-up time controller for controlling the charge-up time of the said charge storage element.

15. An integrated circuit according to claim 14, wherein the charge-up time controller comprises a resistive element.

16. An integrated circuit according to claim 14, wherein the charge-up time controller is connected between the first and second connection means such that the charge-up time controller and the said charge storage element are disposed in series and across the said load.

17. A combination of an integrated circuit according to claim 13 and a momentary switch connected to the activating input in which the integrated circuit and momentary switch are packaged integrally.

18. A combination according to claim 17 in which the integrated circuit is mounted on a packaging substrate and the integrated circuit and momentary switch are encapsulated in an electrically insulating material, the momentary switch protruding out of the electrically insulating material so that it can be actuated externally.

* * * * *